United States Patent [19]

Nigrelli et al.

[11] Patent Number: 4,787,632

[45] Date of Patent: Nov. 29, 1988

[54] GOLF CLUB ACCESSORY FOR RETRIEVING A GOLF BALL

[76] Inventors: Nicholas B. Nigrelli, 13239 West View Rd., Cleveland, Wis. 53015; James Grau, R.R. #1, Elkhart Lake, Wis. 53020

[21] Appl. No.: 156,412

[22] Filed: Feb. 16, 1988

[51] Int. Cl.[4] ..... A63B 53/00; A63B 47/02

[52] U.S. Cl. ..... 273/32 B; 273/32 A; 273/32 F; 273/162 D; 273/162 E; 294/19.2

[58] Field of Search ..... 273/162 R, 162 B, 162 D, 273/162 E, 162 F, 32 R, 32 B, 32 D, 32 F; 294/19.1, 19.2

[56] References Cited

U.S. PATENT DOCUMENTS

| | | | |
|---|---|---|---|
| 1,993,911 | 3/1935 | Abrams | 294/19.2 |
| 2,833,584 | 5/1958 | McEvoy | 294/19.2 |
| 3,922,026 | 11/1975 | Schweitzer | 294/19.2 |
| 4,627,621 | 12/1986 | Tate | 273/32 B |

*Primary Examiner*—Richard C. Pinkham
*Assistant Examiner*—Sebastiano Passaniti
*Attorney, Agent, or Firm*—Ronald E. Barry

[57] ABSTRACT

A golf accessory for retrieving golf balls, repairing divots and placing ball markers, the accessory including a planar member having a ball holder section formed on one side and a flexible ball guide section on the opposite side for biasing the ball into the holder, the guide section including a pair of tapered tines for repairing divots and placing golf ball markers on the green.

8 Claims, 1 Drawing Sheet

GOLF CLUB ACCESSORY FOR RETRIEVING A GOLF BALL

BACKGROUND OF THE INVENTION

1. Field of the Invention.

The present invention relates to a golf club accessory which can be used for retrieving a golf ball, repairing a divot or setting a marker. More particularly, the invention relates to a planar member having a seat formed by two angular sections on one side and a flat section having a pair of tines on the opposite side for biasing the golf ball into the slat. The planar member being adapted to be mounted on the end of a shaft or stick.

2. Description of the Prior Art.

The interest in golf as an outdoor activity for the elderly and the handicapped has increased tremendously over the years. The introduction of the golf cart has made it possible for everybody to participate in the game. Some difficulty has been encountered by golfers who, because of physical disability, are unable to bend over to repair ball marks or other damage to the putting green surface which, if not repaired early, can leave a temporary obstacle on the course. These golfers are further unable to retrieve the golf ball from the cup once it has been holed ,out. There are a number of different types of ball retrievers available, however, none of them include the ability to repair divots or set markers.

SUMMARY OF THE INVENTION

The principal feature of the present invention is to provide a single tool or accessory which can be mounted on the handle of a golf club or stick to allow the golfer to repair divots in the fairway and greens, retrieve a golf ball and set a golf ball marker on the green. It should be noted that although designed for use on a putter, the device is not restricted for use on a putter but may be used on any club or stick for divot repair and pickup; marker pickup and/or placement and ball pickup.

A further feature of the invention is the provision of a single tool which can perform the functions of fairway and green repair, ball retrieval and marker placement and pickup.

Another feature of the invention is the leverage provided by using the device to repair the damaged surfaces of the golf course with a minimum of motion of the club or stick, as well as the increased leverage provided by the length of the handle.

A further feature of the invention is the provision of a spring-biased ball pickup to hold the ball securely while allowing easy removal of the ball from the accessory.

Other principal features and advantages of the invention will become apparent to those skilled in the art upon review of the following detailed description claims and drawings.

Figure 1:
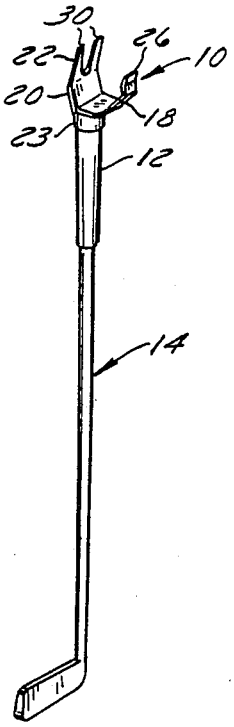
FIG. 1 is a perspective view of a golf club with the accessory mounted on the end of the handle or grip.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

The accessory 10 according to the present invention is shown mounted on the end of the handle or grip 12 of a golf club 14. In the drawing the accessory is shown mounted on the handle of a putter, however it could be attached to the handle or grip of any other club or a stick if so desired.

Figure 2:
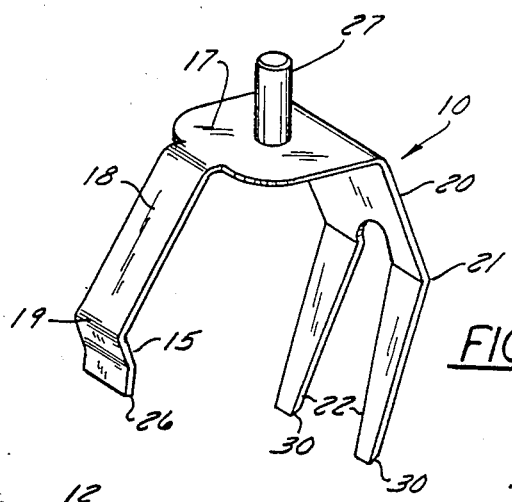
FIG. 2 is a perspective view of the accessory according to the invention.
Figure 3:
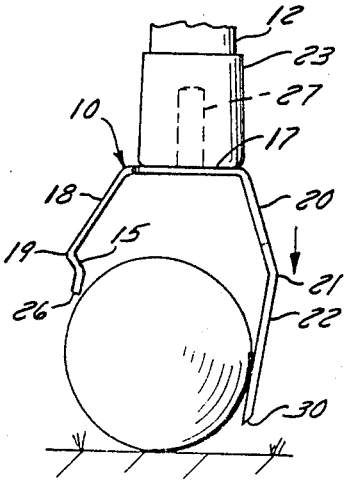
FIG. 3 is a view of the accessory shown positioned for retrieving a golf ball.

The accessory 10 as seen in FIG. 2 includes a planar member 17 in the form of a flat plate of flexible or resilient material. The accessory 10 can be secured to the handle by means of a stainless steel plug 27 or a piece of threaded stock mounted on the planar member 17. With regard to the former, a plastic sleeve 23 is provided on the end of the handle which includes a hole in the end of approximately $\frac{1}{4}$ inch. The plug 27 should have a diameter corresponding to the diameter of the hole to provide a press fit. Other means of attachment can be used such as a detent type mechanism.

Means are provided on one edge of the planar member to hold a golf ball. Such means is in the form of seat 19 provided at the intersection of a first angular section 18 and a second angular section 15. The angle of intersection should be approximately 135 degrees. The end of the extension 15 is offset approximately 17 degrees to provide a guide 26 for camming the section 20 outward as a golf ball is inserted into the holder.

Means are provided on the opposite edge of the member 17 to bias the golf ball 15 toward the seat 19. Such means is in the form of a flat section 20 and a pair of tines 22. The section 20 is bent at an angle downwardly from the member 17 of approximately 75 degrees from the plane of the planar member 17. The length of section 20 should be long enough to reach beyond the middle of the golf ball. The tines 22 are bent inwardly from the end of the section 20 to form a seat 21 for the golf ball at the intersection of the section 20 and tines 22.

The ends of the tines 22 extend inwardly approximately two inches from the plane of the member 20 and are ground to a sharp edge. The distance "a" from the line of intersection 21 of the tines 22 with the section 20 to the seat 19 at the intersection of the section 18 with the extension 15 should be approximately 0.090 inches less than the diameter (1.680 inches) of a golf ball. This will provide a bias on deflection of the section 20 and tines 22 on insertion of a golf ball into the holder which is sufficient to hold the golf ball between the seats 19 and 21. It should also be noted that the tines 22 provide means for centering the golf ball between the tines 22. Such means is in the form of a twist in each of the tines 22 to form a groove for the ball as shown in FIG. 2.

Figure 4:
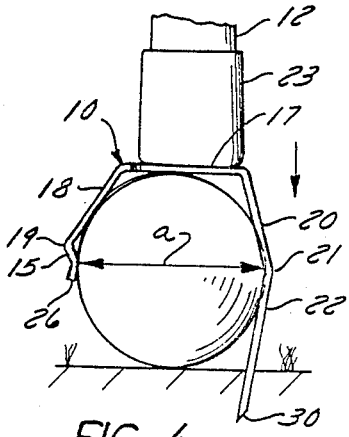
FIG. 4 is a view of the accessory with the golf ball wedged into the accessory.

The ball can be released from the holder by merely pulling the golf ball outwardly against the tines 22 so that the plate 20 is deflected away from the arcuate section 18. The golf ball can also be released, as shown in FIG. 4, by inserting the ends of the tines 22 into the ground and deflecting the tines 22 and plate 20 rearwardly or away from the arcuate section 18 to allow the ball to drop onto the ground.

Figure 5:
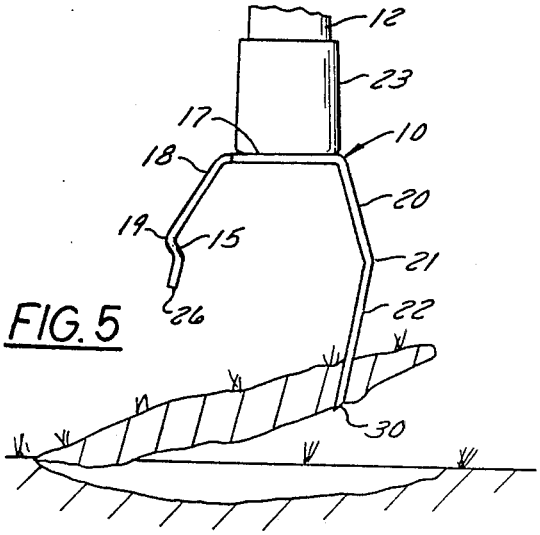
FIG. 5 is a view showing the accessory being used for replacing a divot.

The tines 22 also provide means for repairing a divot in the fairway or in the green. The tapered ends 30 can be used to repair divots by inserting the tines 22 into the ground and manipulating the handle to level the divot. As shown in FIG. 5, the tines can also be used to replace a divot in the fairway by inserting the tines into the divot and returning it to the hole in the fairway.

Figure 6:
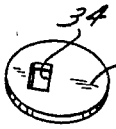
FIG. 6 is a perspective view of a ball marker.
Figure 7:
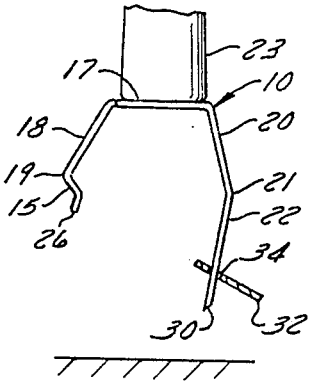
FIG. 7 is a view of the ball marker supported on one of the tines on the accessory.
Figure 8:
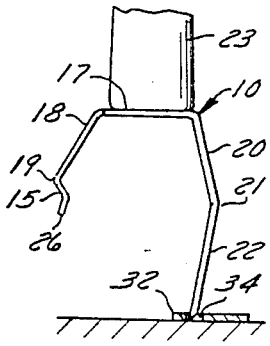
FIG. 8 is a view of the ball marker with one of the tines positioned to pick up the marker.

Means are also provided for placing a ball marker 32 on the surface of a green. The ball marker as seen in FIG. 6 is provided with a slot 34 which is located off-center of the marker. The slot should be slightly larger than the end of the tines 22. The marker 32 is placed on one of the tines 22 and is retained thereon by the off-center weight of the marker which tilts the marker sufficiently to lock the marker in position on the tine 22 as shown in FIG. 7. The marker is released from the tine 22 by lowering the tine 22 toward the green until the edge of the marker 32 touches the green. The marker 32 will tilt with respect to the tine. When the hole 34 approaches a perpendicular relation with respect to the tine 22, the marker will slide off the tine 22 out the green. The marker 32 can be picked up from the green at the same time that the ball is placed on the green by inserting one of the tines 22 into the hole 34 of the marker 32 when the tines are pushed into the ground. The handle is moved forward to deflect the tines to release the ball and then tilt backward to lock the marker on the tine 22.

Thus, it is apparent that there has been provided, in accordance with the invention, a golf accessory that fully satisfies the aims and advantages set forth above. While the invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

The embodiments of the invention in which an exclusive property or privilege is claimed are defined as follows:

1. A golf accessory for retrieving a golf ball, repairing a divot and placing a marker, said accessory comprising a planar member having means on one edge for holding a regulation size golf ball and means on the opposite edge of said member for biasing the golf ball into said holding means, said biasing means including a plate extending outwardly from the planar member and a pair of tines extending outwardly from the plate to provide a guide for pushing the ball into the space between said holding means and said plate.

2. The accessory according to claim 1 wherein said holding means includes a first section extending angularly outwardly from said planar member and a second section extending angularly inwardly from the end of said first section to form a seat at the intersection of said first section and said second angular section.

3. The accessory according to claim 1 or 2 wherein said plate extends outwardly from the planar member past the middle of a regulation size golf ball.

4. The accessory according to claim 1 or 2 where said tines are tapered for repairing divots and further including a golf ball marker having a slot off center from the marker whereby said marker can be picked by inserting one of said tines into said slot in the marker.

5. The accessory according to claim 1 or 2 including means on said planar member for securing said member to the end of a golf club.

6. The accessory according to claim 1 or 2 wherein said tines are twisted inwardly to form a groove for guiding the ball into said holding means.

7. A golf accessory for retrieving a golf ball, repairing a divot or placing a marker, said accessory comprising a planar member having a first section extending angularly outwardly from said planar member and a pair of tines extending angularly inwardly from the end of said first section to form a seat at the intersection of said first section and said tines and a plate extending angularly outwardly from the planar member for biasing a regulation size golf ball into said seat, said tines being tapered for repairing divots and supporting a marker of the type having a slot offset from the center of the marker.

8. The accessory according to claim 7 wherein said tines are twisted inwardly to form a groove for guiding the ball into said seat.

* * * * *